US007283095B2

(12) United States Patent
Karanik et al.

(10) Patent No.: US 7,283,095 B2
(45) Date of Patent: Oct. 16, 2007

(54) ANTENNA ASSEMBLY INCLUDING Z-PINNING FOR ELECTRICAL CONTINUITY

(75) Inventors: James J. Karanik, Brookhaven, NY (US); Dominic Anton, Smithtown, NY (US); Thomas Maurici, Smithtown, NY (US)

(73) Assignee: Northrop Grumman Corporation, Los Angeles, CA (US)

( * ) Notice: Subject to any disclaimer, the term of this patent is extended or adjusted under 35 U.S.C. 154(b) by 16 days.

(21) Appl. No.: 11/349,682

(22) Filed: Feb. 8, 2006

(65) Prior Publication Data

US 2007/0182637 A1 Aug. 9, 2007

(51) Int. Cl.
*H01Q 1/38* (2006.01)

(52) U.S. Cl. ..... 343/700 MS

(58) Field of Classification Search ..... 343/700 MS, 343/789

See application file for complete search history.

(56) References Cited

U.S. PATENT DOCUMENTS 5,512,914 A 4/1996 Hadzoglou et al.
5,757,329 A 5/1998 Hoover et al.
5,823,830 A * 10/1998 Wurster ..... 439/751
5,861,850 A 1/1999 Robertson, Jr. et al.
5,862,975 A 1/1999 Childress
5,980,665 A * 11/1999 Childress ..... 156/92
6,000,977 A 12/1999 Haake
6,027,798 A 2/2000 Childress
6,281,852 B1 8/2001 Amarillas
6,436,507 B1 8/2002 Pannell
6,512,491 B2 1/2003 Kanayama et al.
6,529,139 B1 3/2003 Behun et al.
6,565,942 B2 * 5/2003 Anderson et al. ..... 428/73
2003/0116678 A1 6/2003 Gardner
2004/0023581 A1 2/2004 Bersuch et al.

FOREIGN PATENT DOCUMENTS

EP 0582423 A1 2/1994

* cited by examiner

*Primary Examiner*—Tho Phan
(74) *Attorney, Agent, or Firm*—Robert P. Lenart, Esq.; Pietragallo Bosick & Gordon, LLP

(57) ABSTRACT

An antenna assembly comprises a composite support structure including an electrically conductive outer layer, an inner layer and a core layer between the outer layer and the inner layer; a cavity structure positioned adjacent to the inner layer of the composite support structure; a window structure positioned adjacent to the outer layer of the composite support structure; and a plurality of conductive z-pins passing through the composite support structure and electrically connecting the cavity structure to the outer layer of the composite support structure.

14 Claims, 3 Drawing Sheets

ANTENNA ASSEMBLY INCLUDING Z-PINNING FOR ELECTRICAL CONTINUITY

FIELD OF THE INVENTION

This invention relates to antenna assemblies, and more particularly to antenna assemblies mounted in composite structures.

BACKGROUND OF THE INVENTION

There is a need in many antenna applications to maintain electrical (radio frequency (RF) and/or direct current (DC)) continuity between the antenna ground plane and the antenna cavity. When an antenna assembly is mounted in a composite parent structure such as a vehicle or other structure, this is typically done by removing the parent structure skin and mechanically fastening the antenna cavity directly to the ground plane. If the antenna is installed in a sandwich structure, or one that is made from a nonconductive material, the sandwich or nonconductive structure is similarly removed to make room for the antenna to be installed. In these cases, the load carrying capability of the parent structure is compromised and the structure around the antenna must be reinforced to support expected mechanical loads. This results in a weight penalty.

There is a need for an antenna assembly that provides electrical continuity between the components of the assembly and a parent structure when the parent structure includes nonconducting components.

SUMMARY OF THE INVENTION

This invention provides an antenna assembly comprising a composite support structure including an electrically conductive outer layer, an inner layer and a core layer between the outer layer and the inner layer; a cavity structure positioned adjacent to the inner layer of the composite support structure; a window structure positioned adjacent to the outer layer of the composite support structure; and a plurality of conductive z-pins passing through the composite support structure and electrically connecting the cavity structure to the outer layer of the composite support structure.

DETAILED DESCRIPTION OF THE INVENTION

Figure 1:
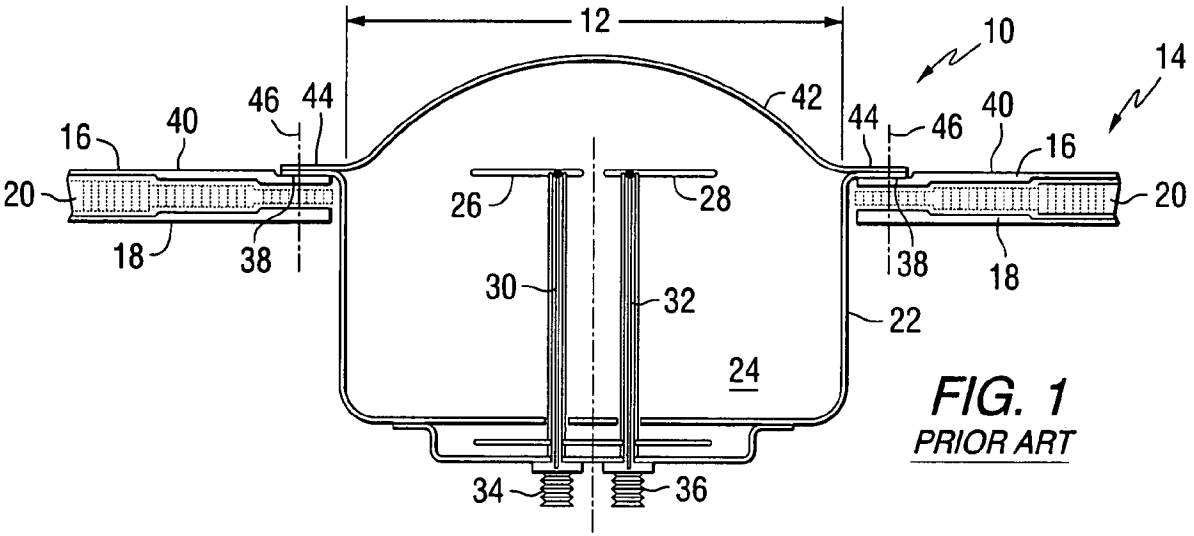
FIG. 1 PRIOR ART
FIG. 1 is a cross-sectional view of a prior art antenna assembly.

Referring to the drawings, FIG. 1 is a cross-sectional view of a prior art antenna assembly 10 forming an antenna aperture 12. The antenna assembly is mounted in a support structure 14, also referred to as a parent structure, which may be the skin of a vehicle. The support structure is a laminated structure including a conductive outer layer 16 that forms a ground plane for the antenna, an inner layer 18, and a core layer 20 positioned between the inner layer and the outer layer. To mount the antenna assembly in the support structure, an opening is cut in the support structure and an electrically conductive antenna cavity structure 22 is inserted into the opening. The cavity structure 22 forms a cavity 24 for housing antenna elements 26 and 28. Antenna element support structures 30 and 32 are provided to support the antenna elements. Connectors 34 and 36 are provided to couple signals to the antenna elements through antenna feeds in the support structures. The cavity structure 22 includes a flange 38 that is positioned adjacent to, and electrically in contact with, an outer surface 40 of the outer layer of the support structure. A window assembly 42 is positioned over the cavity. The window assembly includes a flange 44 that is positioned adjacent to the flange of the cavity structure. Mechanical fasteners pass through the window flange and the cavity flange and are used to secure the antenna assembly to the parent structure. The fasteners could be screws, rivets, or other mechanical fasteners. The lines 46 in FIG. 1 are representative of the centerlines of the mechanical fasteners.

Figure 2:
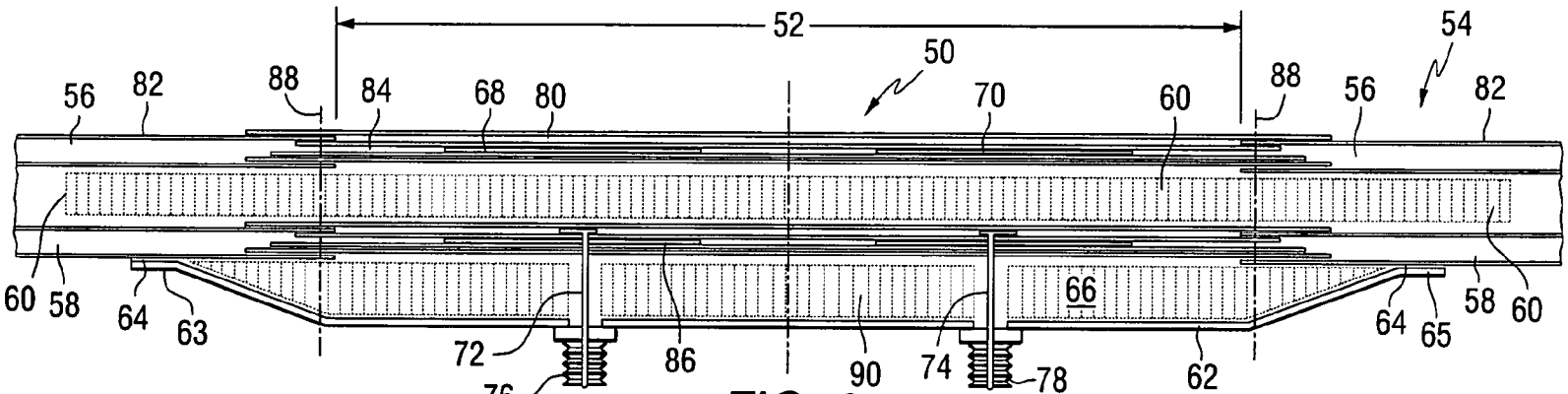
FIG. 2 is a cross-sectional view of an antenna assembly constructed in accordance with the invention.

FIG. 2 is a cross-sectional view of an antenna assembly 50 constructed in accordance with the invention. The antenna assembly forms an antenna aperture 52 and is integral with a support structure 54, also referred to as a parent structure, which may be the skin of a vehicle. The support structure is a laminated structure including a conductive outer layer 56 that forms a ground plane for the antenna, an inner layer 58, and a core layer 60 positioned between the inner layer and the outer layer. The outer layer of the laminated structure could be any conductive fiber matrix composite material. Examples include graphite or boron fibers in an epoxy or thermoplastic resin system. The outer layer should be conductive to serve as a ground plane, but the inner layer can be either conductive or nonconductive, such as fiberglass or similar materials. The core material should be a low dielectric nonconductive material such as Nomex® synthetic fiber, fiberglass or Kevlar® honeycomb, or various nonconductive foams.

An electrically conductive antenna cavity structure 62 includes flanges 63 and 65 positioned adjacent to an inside surface 64 of the inner layer 58 of the support structure. The antenna cavity structure 62 forms a cavity 66 for housing antenna elements 68 and 70 and feed assemblies 72 and 74, which are connected to connectors 76 and 78. The cavity structure can be fabricated from any conductive material such as graphite or boron in an epoxy, thermoplastics, or another matrix system. The cavity could also be constructed of a metal such as aluminum or steel.

A first, or outer, antenna window 80 is positioned adjacent to an outer surface 82 of the outer layer 56 of the support structure. The first window is constructed of a plurality of layers 84 that extend across the aperture in the plane of the outer layer 56 and support the antenna elements. A plurality of layers 86 form a second, or inner, window that extends across the aperture in the plane of the inner layer 58 and supports the feed structures. The windows should be made from a low dielectric material such as fiberglass or quartz in an appropriate matrix system. The RF energy must be able to pass through both windows into the cavity.

The core layer 60 extends through the cavity. The antenna elements can be directly wired or capacitively driven, depending on the specific type of antenna. A plurality of electrically conductive z-pins 88 are positioned around the aperture and pass through the antenna windows, the composite structure, and the cavity structure. The z-pins provide an electrical connection between the cavity structure and the outer layer 56 of the composite structure, which also serves as a ground plane for the antenna. A second layer 90 of core material is positioned within the cavity. Layers 84 and 86 form the two windows described above. They are integrally cured to form a composite sandwich along with the conductive outer layer 56, the inner layer 58, and the sandwich core material. The purpose of these layers is to carry load through the skins, yet be invisible to the RF energy entering or exiting the antenna cavity. In the embodiment of FIG. 2, the second layer of core material 90 is simply used as a "fly-away" tool over which conductive material is layered to form the cavity. Layer 90 is not required if an alternative method for creating the cavity is selected.

Z-pins, which are thin fibers of graphite, titanium or other materials, have been used in the past to provide structural reinforcement perpendicular to the plies of composite structures. This invention uses z-pins to provide electrical continuity (RF and/or DC) through the thickness of a composite or other structure in order to ensure electrical continuity between an antenna cavity and an associated ground or embedment plane without the need to remove or significantly compromise the parent material or structure. The outer layer 56 of the parent conductive structure doesn't exist in the window area. It is replaced by the window material in both the outside and inside layer. When the composite sandwich structure is layed up, window plies of low dielectric material are layered into the conductive layers (56). The same is done in the inside surface.

Figure 3:
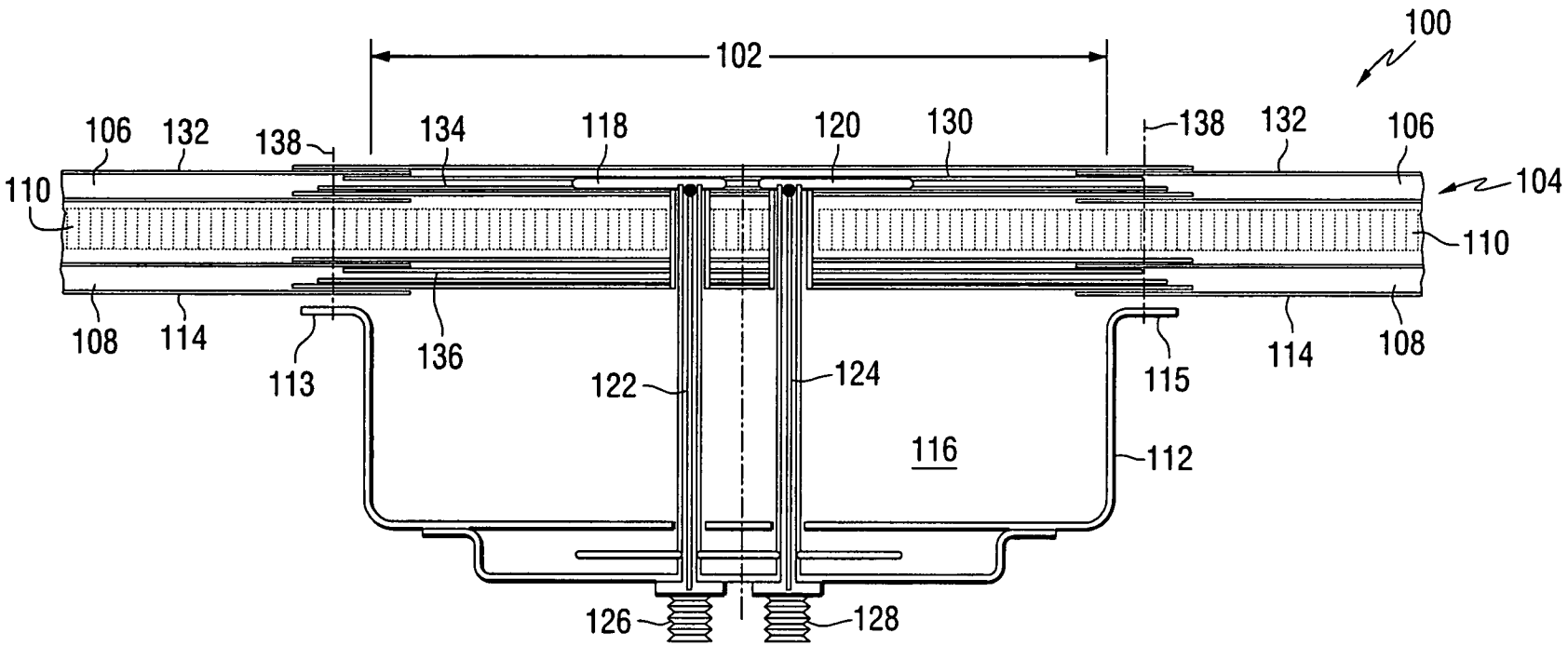
FIG. 3 is a cross-sectional view of another antenna assembly constructed in accordance with the invention.

FIG. 3 is a cross-sectional view of a portion of an antenna assembly 100 constructed in accordance with the invention. The antenna assembly forms an antenna aperture 102 and is integral with a support structure 104, also referred to as a parent structure, which may be the skin of a vehicle. The support structure is a laminated structure including a conductive outer layer 106 that forms a ground plane for the antenna, an inner layer 108, and a core layer 110 positioned between the inner layer and the outer layer. An electrically conductive antenna cavity structure 112 includes flanges 113 and 115 positioned adjacent to an inside surface 114 of layer 108 of the support structure. The cavity structure 112 forms a cavity 116 for housing antenna elements 118 and 120 and feed assemblies 122 and 124. Connectors 126 and 128 are provided to couple signals to the antenna elements through the feed assemblies.

A first, or outer, antenna window 130 is positioned adjacent to an outer surface 132 of layer 106 of the support structure. The first window is constructed of a plurality of layers 134 that extend across the aperture in the plane of the outer layer 106 and support the antenna elements. A plurality of layers 136 form a second window that extends across the aperture in the plane of the inner layer 108 and supports the feed structures. The core layer 110 extends through the cavity. A plurality of electrically conductive z-pins 138 are positioned around the aperture and pass through the antenna windows, the composite structure, and the cavity structure. The z-pins provide an electrical connection between the cavity structure and the outer layer 106 of the composite structure, which also serves as a ground plane for the antenna. The material examples described for the embodiment of FIG. 2 can be used to construct the embodiment of FIG. 3.

Figure 4:
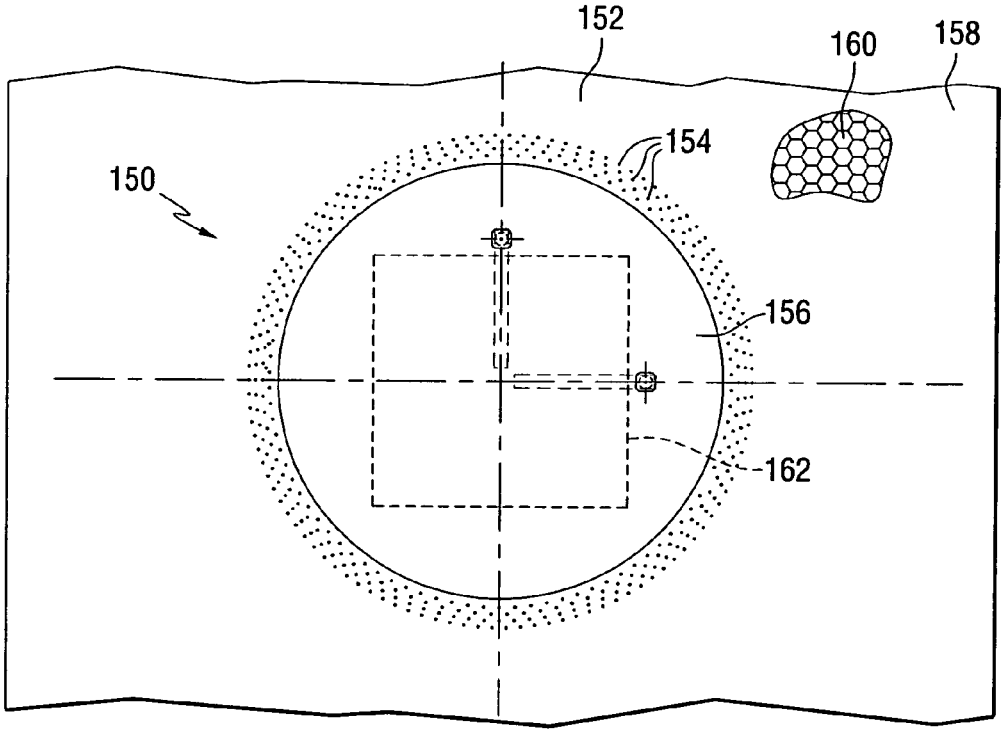
FIG. 4 is a plan view of an antenna assembly constructed in accordance with the invention.

FIG. 4 is a plan view of an antenna structure 150 mounted in a support structure 152 in accordance with the invention. A plurality of z-pins 154 are inserted around the periphery of antenna aperture (or window) 156 of the structure. The support structure includes a conductive outer ply 158 over a honeycomb structure 160. An embedded antenna element is shown as item 162. The spacing of the z-pins is dependent upon the frequency that the antenna is designed for and the allowable RF energy leakage acceptable in a specific application. Typically the spacing of 1/100 wavelength is a good rule of thumb.

As shown in the sandwich structure shown in FIG. 2, the z-pins provide electric continuity from the outer surface, through a core material (honeycomb, foam or other) and through the composite back plane or antenna cavity. Similarly, as shown in FIG. 3, the z-pins provide electrical continuity through the parent sandwich structure to a conductive antenna cavity fastened behind the sandwich structure. In each embodiment, the use of z-pins provides electrical continuity without cutting through the core material and without the increase in weight that results from a core splice or reinforcement required in the prior art.

The parent structures in the antenna assemblies of the described embodiments include two or more RF conductive organic matrix composite skins separated by a nonconductive core or spacer material. The z-pins can be ultrasonically inserted through the uncured laminate that is then cured to form a structurally integrated load bearing composite component. The z-pins provide both electrical conductivity and structural enhancement between the skin layers. Conventional mechanical fasteners require the drilling of holes that reduce the load carrying capability of the structure. However, integrally cured z-pins used in the antennas of FIGS. 2 and 3 require no hole drilling and actually improve through-the-thickness load carrying capability.

The embedded z-pins become an integral part of the structure during the normal cure cycle required for solidifying or bonding of the composite structure. The number, type, location and material of the z-pins can be tailored to meet specific structural, conductivity and RF requirements without significantly affecting installation time or part fabrication.

The antenna assembly is integral with the support structure. This eliminates the need for external assembly, mating parts, or spring-loaded fingers or contacts. The electrically conductive z-pins become part of the load bearing structure, as well as providing electrical continuity. The z-pin can be made of various conductive materials. Typically, they are graphite or metallic.

Insertion of z-pins increases the "through-the-thickness" tensile/compressive strength of the structure, which inherently improves damage tolerance and provides a mechanism for the arrestment of crack propagation.

While the invention has been described in terms of several embodiments, it will be apparent to those skilled in the art that various changes can be made to the described embodiments without departing from the scope of the invention as set forth in the following claims.

What is claimed is:

1. An antenna assembly comprising:

a composite support structure including an electrically conductive outer layer, an inner layer and a core layer between the outer layer and the inner layer;

a cavity structure positioned adjacent to the inner layer of the composite support structure;

a first window structure positioned adjacent to the outer layer of the composite support structure; and a plurality of conductive z-pins passing through the composite support structure and electrically connecting the cavity structure to the outer layer of the composite support structure, wherein the core layer extends through the assembly.

2. The antenna assembly of claim 1, wherein the core layer is non-conductive.

3. The antenna assembly of claim 1, wherein:

the cavity structure includes a flange along a periphery of the cavity structure; and the plurality of conductive z-pins pass through the window structure and into the cavity structure flange.

4. The antenna assembly of claim 1, further comprising:

a second layer of non-conductive material positioned in the cavity structure.

5. The antenna assembly of claim 1, further comprising:

a second window structure positioned adjacent to the inner layer of the composite support structure.

6. The antenna assembly of claim 1, wherein the z-pins are constructed of one of:

a graphite or a metal.

7. The antenna assembly of claim 1, wherein the conductive layer comprises:

a conductive fiber matrix composite material.

8. The antenna assembly of claim 7, wherein the conductive fiber matrix composite material comprises one of:

graphite or boron fibers in an epoxy, or a thermoplastic resin.

9. The antenna assembly of claim 1, wherein the core layer is constructed of one of:

a synthetic fiber, a honeycomb structure, or a non-conductive foam.

10. The antenna assembly of claim 1, wherein the inner layer is constructed of:

fiberglass.

11. The antenna assembly of claim 1, wherein the cavity structure is constructed of one of:

graphite or boron in an epoxy, thermoplastic, aluminum, or steel.

12. The antenna assembly of claim 1, wherein the first window structure is positioned adjacent to a first side of the core layer of the composite support structure, and the assembly further comprises:

a second window structure positioned adjacent to a second side of the core layer.

13. The antenna assembly of claim 12, wherein the first window, the second window, and the core layer are integrally cured.

14. An antenna assembly comprising:

a composite support structure including an electrically conductive outer layer, an inner layer and a core layer between the outer layer and the inner layer;

a cavity structure positioned adjacent to the inner layer of the composite support structure;

a window structure positioned adjacent to the outer layer of the composite support structure;

a second window structure positioned adjacent to the inner layer of the composite support structure; and a plurality of conductive z-pins passing through the composite support structure and electrically connecting the cavity structure to the outer layer of the composite support structure.

* * * * *